US005248213A

United States Patent [19]

Seager et al.

[11] Patent Number: 5,248,213

[45] Date of Patent: Sep. 28, 1993

[54] SEAL FOR ROLL-ON DISPENSER

[75] Inventors: Richard H. Seager, Mystic, Conn.; Alex S. Szekely, Edison, N.J.; Alfred Astoreca, Annandale, N.J.; Robert Sheffler, Morganville, N.J.; Christopher S. Thorp, Mystic, Conn.

[73] Assignee: Plastek Industries, Inc., Erie, Pa.

[21] Appl. No.: 826,435

[22] Filed: Jan. 27, 1992

[51] Int. Cl.[5] ..... B05C 17/02

[52] U.S. Cl. ..... 401/208; 401/213; 215/231; 222/513

[58] Field of Search ..... 401/208, 213, 246, 247, 401/219, 220; 215/341, 231; 222/513, 516, 511

[56] References Cited

U.S. PATENT DOCUMENTS

| | | | |
|---|---|---|---|
| 819,235 | 5/1906 | Lorenz | 215/231 X |
| 2,716,504 | 8/1955 | Martin | 215/341 X |
| 2,910,712 | 11/1959 | Schaich et al. | 401/213 |
| 4,030,844 | 6/1977 | Lench et al. | 401/213 |
| 4,168,128 | 9/1979 | Fillmore et al. | 401/213 |
| 4,221,494 | 9/1980 | Kachur | 401/213 |
| 4,475,837 | 10/1984 | Dornbusch et al. | 401/213 |
| 4,840,511 | 6/1989 | Fattori et al. | 401/213 |
| 4,858,776 | 8/1989 | Mehra | 215/341 X |

*Primary Examiner*—Danton D. DeMille
*Attorney, Agent, or Firm*—Bachman & LaPointe

[57] ABSTRACT

A seal means for a roll-on liquid dispenser in the form of an expansible web which elongates biaxially to overlay the roller and seal the dispensing passage when a dispenser closure is moved to a closed position.

5 Claims, 3 Drawing Sheets

SEAL FOR ROLL-ON DISPENSER

BACKGROUND OF THE INVENTION

The present invention relates to liquid dispensers and relates, in particular, to so-called roll-on dispensers wherein a liquid container is formed with an opening defining a socket for receiving a roller in the form of a sphere or a cylinder.

The roller is rotatable in the socket, and by virtue of gravity, adsoption and/or surface tension, liquid material within the container is dispersed at the junction of the roller and the socket.

That is, the roller "picks up" liquid from the interior of the container and as the roller rotates in the socket, the liquid is dispensed through a generally continuous passage defined by the junction of the roller and the peripheral lip of the socket.

Obviously, there must be controlled clearance between the socket and the roller so that the roller can rotate freely and to provide passage for dispensing liquid.

The roller is usually snapped into position within the socket and retained by a socket lip whose peripheral dimension is slightly less than the corresponding dimension of the roller. The liquid container includes a cover or an overcap for protecting the roller and for closing the container.

Some prior art units use stub shafts at opposed ends of a cylindrical roller to support the roller rotatably.

A typical prior art roll-on dispenser utilizing a cylindrical roll is disclosed and described in U.S. Pat. No. 4,840,511 to Fattori et al., issued Jun. 20, 1989.

A spherical roller is incorporated in a liquid dispenser distributed by the CARTER PRODUCTS division of CARTER-WALLACE INC., NEW YORK, N.Y. 10153, packaging ARRID ® EXTRADRY ® antiperspirant and deodorant.

While these roll-on applicators are operable to dispense liquids, there is considerable difficulty in sealing the liquid dispensing passage between the roller and the lip or periphery of the socket into which the roller is seated.

That is, during transit of product from point of manufacture to point of sale, at retail, liquid tends to leak from the container at the space between the socket lip and the roller. Some liquids require agitation (shaking) before dispensing, which also leads to leakage.

This occurrence is obviously undesirable in that leakage mars the package in which the container is displayed and may even leave residue on the display shelf. Frequently, leakage results in liquid collecting inside the cover which spills upon the user when the cover is removed prior to dispensing.

Several compressible media, contained in the cover, such as the resilient liner of the said '511 patent, have been devised to solve the leakage problem with varying degrees of success.

SUMMARY OF THE INVENTION

In contrast to the prior art, the present invention involves the use of a seal means defining a plastic member having a web portion wherein the web portion is elongated automatically as the container cover is moved to a closed position.

That is, the cover operates to expand and elongate the web portion biaxially to overlay the roller and the dispensing passage snugly to form a liquid tight seal when the web is in a tension mode.

The seal means is shaped, generally, in the form of a cup (first cup) and includes a bottom wall or web contiguous with a continuous sidewall.

The cup is inserted into a container cover which defines a second cup having a top wall contiguous with a continuous depending sidewall.

That is, the bottom wall or web of the first cup is spaced from the top wall of the cover.

Means are incorporated into the interior of the cover for gripping the seal means so that as the closure is advanced into a closed position, the bottom wall or web of the seal means is expanded or stretched to overlay and conform to the contour of the roller and to provide a continuous skin which overlays, seals and extends beyond the dispensing passage positively.

For purposes of claiming the present invention, it is to be noted that the term "roller" is intended to include rollers in the shape of a sphere, ellipsoid or cylinder.

In some embodiments of the invention, depending upon the shape of the roller and the elastic memory of the seal means, it may be desirable to preshape the web portion of the seal means to a contour approaching the contour of the roller.

Therefore, it is a prime object of the present invention to provide a new and improved seal device for a roll-on liquid dispenser.

It is a further object of the invention to provide an elastic web which, in its expanded form, overlaps and seals the roller and extends beyond the dispensing joint between the roller and the container.

It is a further feature of the invention to provide an elastic member for accomplishing the above seal wherein the material from which the elastic member is fabricated has a tensile strength in excess of at least 300 p.s.i., a tensile modulus of at least 55 p.s.i., an ultimate elongation of at least 250%, a tear strength of at least 90 p.s.i. and a resilience of at least 20%.

It is a further feature of the insertion to provide a method of fabricating the elastic member.

A still further feature involves a method of inserting the seal means into the cover.

A seal device embracing certain principles of the present invention may comprise a liquid container, a dispensing roller, a socket in said container for receiving said roller whereby said roller is rotatable in said socket to dispense fluid from said container, a cover for closing said container, elastic seal means carried by said cover operable to expand and to seal said roller relative to said socket so that when the container is closed by said cover and said roller is at rest, no liquid is dispensed from the container, and means incorporated in said cover for retaining said seal means.

A method of sealing a roll-on liquid dispenser incorporated into a container having a cover against undesirable leakage at the junction of the roller and the roller socket embracing certain other principles of the invention may comprise the steps of providing in said cover a seal means having an elastic web portion, expanding said web portion so that it overlays said roller and bridges the junction between the roller and the roller socket to effect said seal and utilizing the cover during its movement to a closed container position to perform the expanding step.

Other features and advantages will become apparent from an examination of the succeeding specification when read in conjunction with the appended drawings, in which:

BRIEF DESCRIPTION OF THE DRAWINGS

The roller may take the form initially of a parison which is subsequently blow molded into the desired configuration i.e., ellipse, cylinder or sphere. Thereafter the molded Plug 180 is inserted to enclose and complete the formulation of the roller

DETAILED DESCRIPTION OF THE INVENTION

Figure 3:
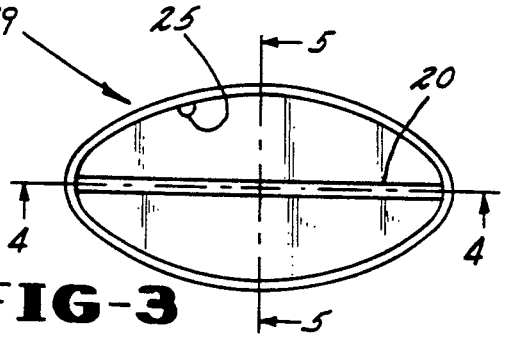
FIG. 3 is plan view of the interior of one embodiment of an elastic seal means.

Referring to FIGS. 1 through 7, a roll-on liquid dispenser indicated by the reference numeral 11 includes a plastic fluid container body 12 having an opening 13 defined by a neck portion 14 and a peripheral flexible lip 16 forming a socket 17 for an ellipsoid roller 18. The roller is retained rotatably in the socket with appropriate peripheral clearance at the junction of the roller and the lip to allow free rotation of the roller and to provide passage for fluid in well-known fashion.

Many of the fluids dispensed require mixing before application; therefore, one must shake the container vigorously in the closed condition to accomplish mixing. If the seal at liquid passage is not fluid tight, liquid is lost to the interior of the container and frequently bleeds to the container packaging and to store shelving.

Figure 4:
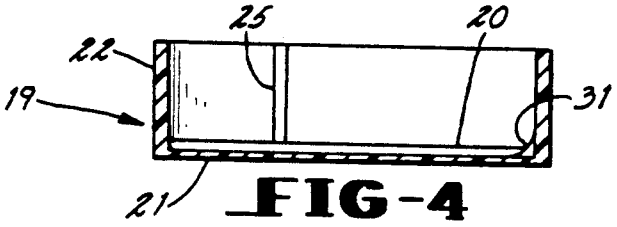
FIG. 4 is a longitudinal vertical section of FIG. 3 along line 4—4.
Figure 5:
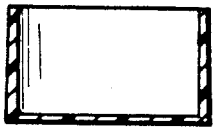
FIG. 5 is a transverse vertical section of FIG. 3 along line 5—5.
Figure 1:
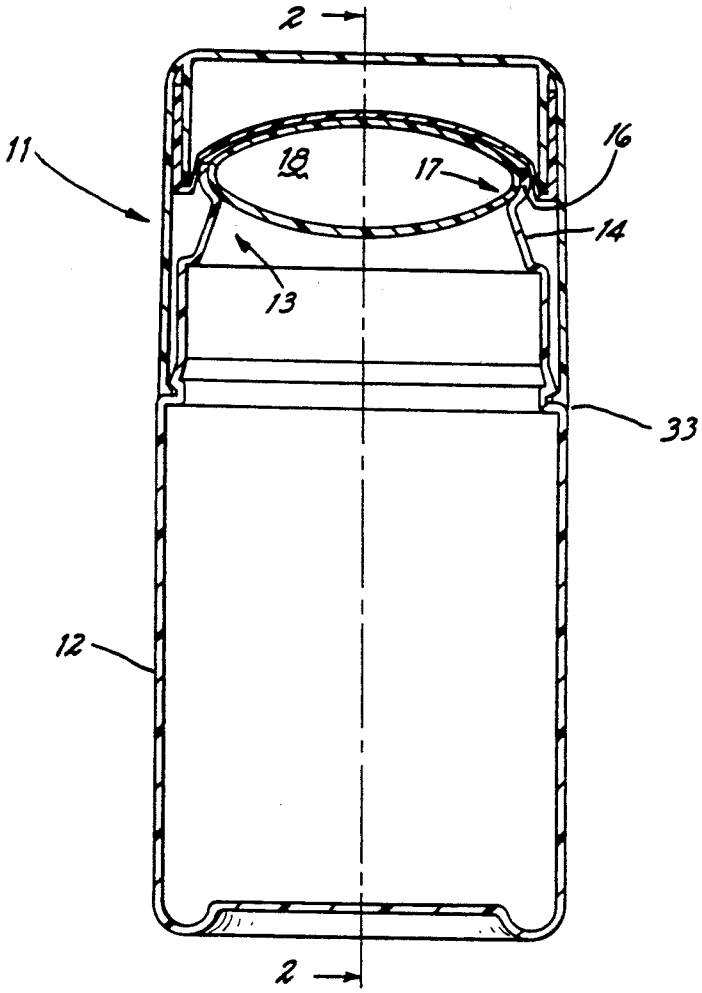
FIG. 1 is a front vertical section of a roll-on liquid dispenser incorporating the seal means of the present invention.
Figure 2:
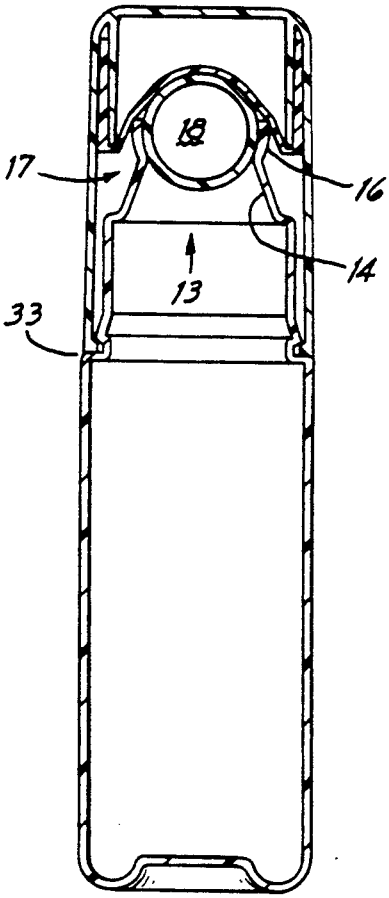
FIG. 2 is a vertical section of the illustration of FIG. 1 as viewed in the plane represented by the line 2—2.
Figure 6:
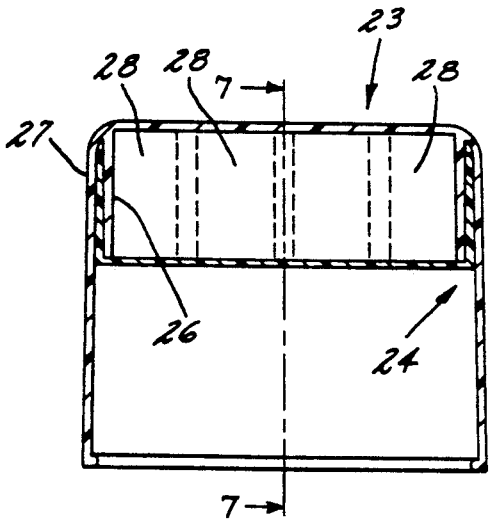
FIG. 6 is a front vertical section of the dispenser cover with the seal means positioned in the cover.
Figure 7:
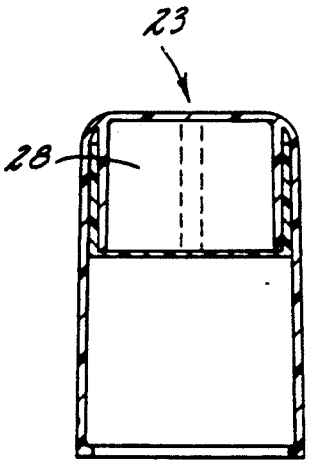
FIG. 7 is a vertical section of FIG. 6 as viewed in the plane represented by the line 7—7.

To solve the seal problem, a first plastic cup (seal means) indicated generally at 19 in FIGS. 3 and 4 having a bottom wall 21 defining a relatively thin elastic web and a contiguous, continuous sidewall 22 is disposed in the container cap or cover 23 (second cup) in the manner shown in FIGS. 6 and 7.

Figure 6A:
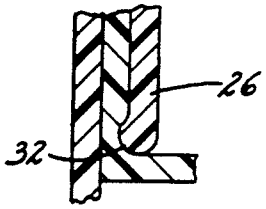
FIG. 6A is a view of a portion of FIG. 6 showing a lock means between the cover and the seal means.
Figure 6B:
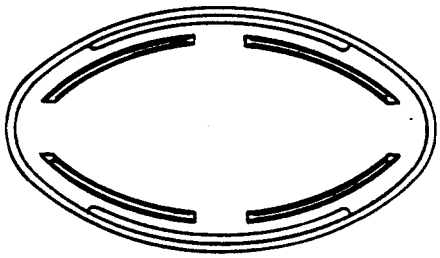
FIG. 6B is a plan view of the interior of one embodiment of the cover.

The plastic material from which at least the web portion of the cup 19 is fabricated is elastic and, as stated earlier, it is essential that the plastic material have a tensile strength greater than 300 p.s.i., a tensile modules greater than 55 p.s.i., an ultimate elongation greater than 250%. a tear strength greater than 90 p.s.i. and a resilience greater than 20%. Suitable plastic materials for fabricating the cup include but are not limited to natural an/or synthetic rubbers, thermoplastic elastomers and combinations thereof. Referring to FIGS. 6 and 7 note that the sidewall of the cup 19 is received within an annular slot 24 formed in the interior of the cover cup 23 sandwiched between a depending skirt 26 and the sidewall 27 of the cover. The skirt 26 can be continuous as shown in solid lines or comprised of a series of spaced tines or fins 28 as indicated by the dotted lines in FIGS. 6 and 7 and as shown more clearly in FIG. 6B.

Figure 8:
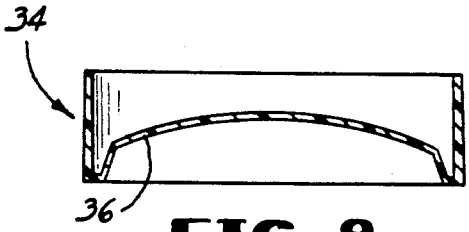
FIGS. 8, 9 and 10 show an alternative embodiment of the seal means.

The sidewall of the elastic cup may be tapered as shown in FIG. 8 to facilitate assembly into the cover 23.

The sidewall 22 may be formed with at least one rib for stiffening the wall as shown at 25 in FIGS. 3 and 4.

In addition, it has been found desirable to include a small radius 31 (FIG. 4) at the junction of sidewall 22 and bottom wall 21 of the cup 19. In addition, a bead 32 (FIG. 6A) at the tip of the skirt 26 operates to retain the cup 19 within the cover 23 and tends to minimize strain as the elastic web (bottom wall 21) expands biaxially to overlay the roller 18 and to overlay the dispensing passage (junction between the lip 16 and the roller 18) when the closure 23 is moved from the position of FIGS. 6 and 7 to the closed and sealed position of FIGS. 1 and 2.

To enhance the tensile strength of the web 21, a rib 20 may be incorporated as shown in FIGS. 3 and 4.

The cover 23 makes a releasable latch or interlock connection with the container (FIGS. 1 and 2) as at 33 in well-known fashion.

It is well to note that, in view of the elasticity of the web 21, the positive drive of the skirt 26, (or tines 28) and the retaining action of the latch 33, the web stretches, elongates and conforms faithfully to the contour of the roller 18 and overlays, covers and extends beyond the dispensing passage and the lip 16 providing a taut skin effecting a fluid tight seal.

That is, vibration, shaking and general motion of the closed container does not affect the integrity of the liquid tight seal.

In contrast to a pressure seal, as in the conventional water faucet pressure seal, the present invention provides a liquid tight seal by expanding an elastic web to provide a skin in the fashion that such a skin is provided when one draws a rubber glove over the fingers of one's hand.

Figure 9:
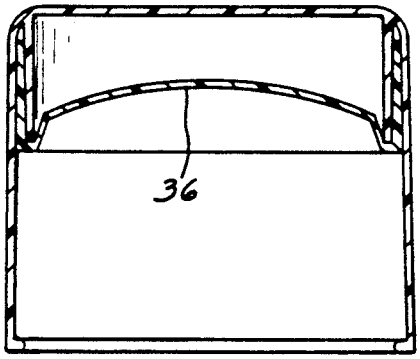
Figure 10:
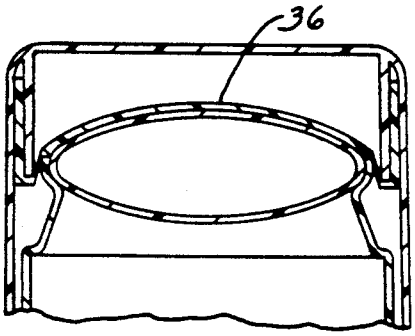

FIGS. 8, 9 and 10 show an alternative embodiment of the seal means as indicated by the reference numeral 34 wherein the bottom wall or elastic web 36 is preformed (molded) to a configuration which is intermediate between the FIG. 4 configuration of the web and the final fully elongated configuration of FIG. 10.

This preform reduces strain and enhances the life of the seal means.

Figure 11:
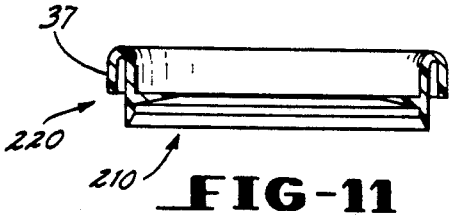
FIGS. 11, 11A, 12 and 13 show a still further embodiment of the seal means.
Figure 12:
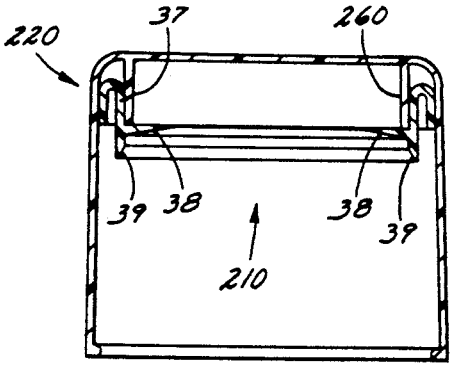
Figure 13:
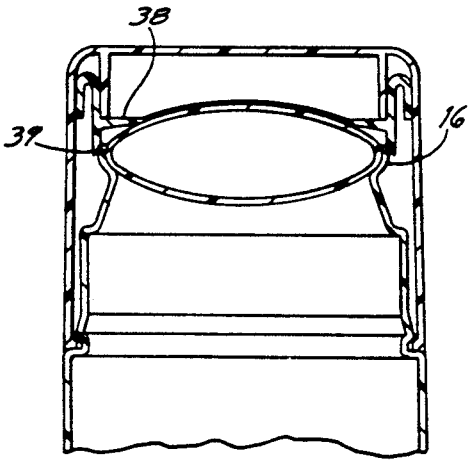

FIGS. 11, 12 and 13 show a still further embodiment of the seal means wherein the sidewall 220 terminates at its upper end in a return bend portion 37.

The bottom wall 210 is molded with an inwardly projecting thickened portion or shoulder 38 surrounding the relatively thin web or bottom wall 210 and a bevelled tip 39.

The shoulder 38 provides a firm base or support for the skirt 260 during the web expansion step and the bevelled tip 39 leads the elastic bottom wall 210 over and beyond the lip 16.

Figure 11A:
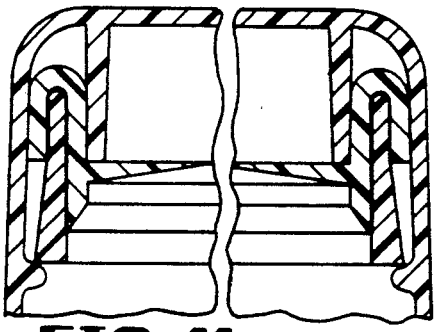

FIG. 11A shows a method of inserting the seal means into the cover 23 wherein a stiff ring or collar 41 is inserted into the return bend portion 37 of the seal means and the collar is pressed inwardly until the shoulder 38 of the seal means contacts the skirt 26.

The collar 41 snaps over cover bead 42 to retain the seal means.

Figure 14:
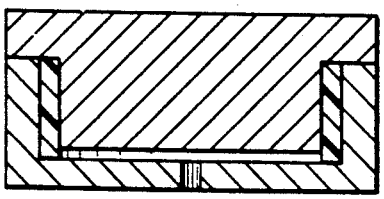
FIGS. 14 and 14A show a method of manufacturing a seal means.
Figure 10A:
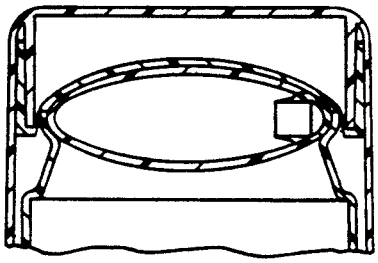
FIG. 10A show a roller 18 having a plug 180. This disclosure is primarily for the purpose of showing a method of fabricating the roller. That is, the mainbody of the roller is molded with an opening 0 and thereafter the plug 180 is inserted to complete the body of the roller. In the alternative the roller must be machined from solid stock at great waste and expense.
Figure 14A:
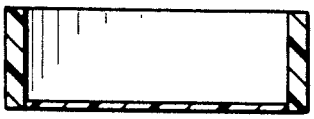

FIGS. 14 and 14A show an alternative seal means S and method of manufacture wherein a mold M is fitted with a rigid, plastic, generally elliptical (or circular) insert I. Thereafter a flexible plastic material of suitable elastic properties (as noted previously) is injected into the mold to produce the seal means S.

This method and structure provides a seal means having a rigid sidewall R with an elastic web W facilitating insertion of the seal means S into the container cover manually or by automatic machinery without the need for an extra instrumentality such as the collar 41 of FIG. 11A.

As stated previously, it is to be understood that the present invention includes seal means as well as method steps practiced to accomplish the seal wherein a peripheral closure is established at the dispensing passage of a roll-on dispenser. A container closure of the type described is provided with an internal elastic web and the closure is utilized upon being placed in a closed position to expand the web to effect a liquid tight overlay or skin upon the roller and the dispensing passage.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A seal assembly for a roll-on liquid dispenser comprising:

a liquid container, a dispensing roller, socket in said container having a lip for receiving said roller whereby said roller is rotatable in said socket to dispense fluid from said container at a junction between the roller and the lip of said socket, a cover for closing said container, seal means defining a flexible, plastic cup member having a bottom wall defining an elastic web carried by said cover, said seal means further defining a continuous sidewall contiguous with said bottom wall, said cover including an internal generally peripheral slot for receiving said sidewall of said seal means, said slot being bound by a substantially peripheral skirt operable to engage the junction between the sidewall and bottom wall of the seal means whereby the skirt operates to expand the bottom wall of the seal means to conform with and overlay the roller and the periphery of the socket including the socket lip to create a liquid tight seal, said elastic web being further operable when the cover is moved to a closed container position to expand and elongate areally to overlay the roller and to overlay and seal the junction between the roller and the socket creating said liquid tight seal.

2. The assembly of claim 1 in which the peripheral skirt terminates in a bead operable to reduce stress at the junction between the bottom wall and the sidewall of the seal means.

3. A seal assembly for a roll-on liquid dispenser comprising:

a container having an opening defining a socket, a roller disposed rotatable in said socket whereby rotation of said roller is operable to dispense liquid from said container, said liquid emerging at a peripheral junction between the roller and the socket, cover means including an outer wall for closing said container, said cover means including an elastic means;

said elastic means defining a web portion and a web support portion, said cover means further including means for supporting the web support portion of said elastic means, said supporting means including an internal, concentric, substantially continuous wall spaced radially inward from said outer wall to define a slot, the web support portion of said elastic means of being received in said slot, said outer wall of said cover means being operable to engage the container releasably to close the container, said supporting means of said cover means being operable to retain said elastic means whereby said web means expands areally to conform with and to overlay said roller and to overlay and seal said peripheral junction when the cover means is in the closed position.

4. The seal assembly of claim 3 wherein the cover means defines a first cup-like member and the web portion and the web support portion of the elastic means define a second cup-like member.

5. A seal assembly for a roll-on liquid dispenser comprising:

a liquid container, a dispensing roller, a socket in said container having a lip for receiving said roller whereby said roller is rotatable in said socket to dispense fluid from said container at a junction between the roller and the lip of said socket, a cover for closing said container, and seal means comprising a flexible, plastic cup member having a bottom wall defining an elastic web carried by said cover, said elastic web being operable when the cover is moved to a closed container position to expand and elongate areally to overlay the roller to overlay and seal the junction between the roller and the socket and to extend beyond the lip of said socket, said seal means including a continuous sidewall contiguous with a said bottom wall, the sidewall of the seal means being formed with a return bend portion, and a relatively rigid ring, one edge of the ring engaging the return bend portion of said sidewall, the opposite edge of said ring engaging a bead formed on the interior of the cover whereby the ring is operable to drive the seal means into the cover and is further operable to lock the seal means to the cover.

* * * * *